US010798494B2

(12) United States Patent
Kamkar-Parsi et al.

(10) Patent No.: US 10,798,494 B2
(45) Date of Patent: Oct. 6, 2020

(54) HEARING APPARATUS

(71) Applicant: Sivantos Pte. Ltd., Singapore (SG)

(72) Inventors: Homayoun Kamkar-Parsi, Erlangen (DE); Henning Puder, Erlangen (DE); Dianna Yee, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 55 days.

(21) Appl. No.: 15/722,318

(22) Filed: Oct. 2, 2017

(65) Prior Publication Data

US 2018/0027340 A1 Jan. 25, 2018

Related U.S. Application Data

(63) Continuation of application No. PCT/EP2016/057271, filed on Apr. 1, 2016.

(30) Foreign Application Priority Data

Apr. 2, 2015 (EP) ..... 15162497

(51) Int. Cl.
*G10L 21/0216* (2013.01)
*G10L 21/02* (2013.01)
(Continued)

(52) U.S. Cl.
CPC ..... *H04R 25/407* (2013.01); *H04R 25/552* (2013.01); *H04R 25/554* (2013.01);
(Continued)

(58) Field of Classification Search
CPC .... H04R 25/407; H04R 25/554; H04R 3/005; H04R 25/552; H04R 25/558;
(Continued)

(56) References Cited

U.S. PATENT DOCUMENTS 8,036,405 B2 10/2011 Ludvigsen et al.
8,670,583 B2 3/2014 Endo et al.
(Continued)

FOREIGN PATENT DOCUMENTS

EP 2088802 A1 8/2009
EP 216 1949 A2 3/2010
(Continued)

OTHER PUBLICATIONS

Translation of Japanese Office Action dated Aug. 28, 2018 in corresponding application 2017-551306.
(Continued)

*Primary Examiner* — Fan S Tsang
*Assistant Examiner* — Julie X Dang
(74) *Attorney, Agent, or Firm* — Muncy, Geissler, Olds & Lowe, P.C.

(57) ABSTRACT

A method of operating a hearing apparatus and hearing apparatus having at least one of a first microphone or a second microphone which generate a first microphone signal and a second microphone signal respectively, the first microphone and the second microphone being arranged in at least one of a first hearing device and a second hearing device, a third microphone which generates a third microphone signal, the third microphone being arranged in an external device, and a signal processing unit, wherein in the signal processing unit the third microphone signal and at least one of the first microphone signal or the second microphone signal are processed together thereby producing an output signal with an enhanced signal to noise ratio compared to the first microphone signal and/or the second microphone signal.

21 Claims, 2 Drawing Sheets

(51) Int. Cl.
*H04R 25/00* (2006.01)
*H04R 5/027* (2006.01)

(52) U.S. Cl.
CPC .... *G10L 21/02* (2013.01); *G10L 2021/02165* (2013.01); *H04R 5/027* (2013.01)

(58) Field of Classification Search
CPC ..... H04R 25/453; H04R 25/505; H04R 2460/01; H04R 2225/41
USPC ..... 381/312, 92, 315, 71.6, 94.7
See application file for complete search history.

(56) References Cited

U.S. PATENT DOCUMENTS

| | | | | |
|---|---|---|---|---|
| 8,855,341 | B2 | 10/2014 | Kim et al. | |
| 9,036,845 | B2 | 5/2015 | Rasmussen et al. | |
| 9,906,874 | B2 | 2/2018 | Shilton | |
| 2006/0147054 | A1* | 7/2006 | Buck | H04R 3/005 381/92 |
| 2007/0160254 | A1 | 7/2007 | Ritter et al. | |
| 2008/0317259 | A1* | 12/2008 | Zhang | G10L 15/04 381/92 |
| 2009/0141907 | A1* | 6/2009 | Kim | G10L 21/0208 381/71.7 |
| 2009/0190774 | A1* | 7/2009 | Wang | G10L 21/028 381/92 |
| 2009/0202091 | A1 | 8/2009 | Pedersen et al. | |
| 2009/0304203 | A1* | 12/2009 | Haykin | G10L 21/02 381/94.1 |
| 2010/0046775 | A1 | 2/2010 | Tiefenau | |
| 2010/0195836 | A1 | 8/2010 | Platz | |
| 2011/0288860 | A1 | 11/2011 | Schevciw et al. | |
| 2011/0293103 | A1* | 12/2011 | Park | G10L 21/0208 381/57 |
| 2012/0020503 | A1* | 1/2012 | Endo | G10L 21/0272 381/312 |
| 2014/0029777 | A1* | 1/2014 | Jang | H04R 25/554 381/315 |
| 2014/0050326 | A1 | 2/2014 | Vesa et al. | |
| 2014/0172421 | A1* | 6/2014 | Liu | H04R 1/1083 704/227 |
| 2015/0049892 | A1* | 2/2015 | Petersen | H04R 25/554 381/315 |
| 2015/0156578 | A1* | 6/2015 | Alexandridis | H04R 3/005 381/92 |
| 2016/0241948 | A1* | 8/2016 | Liu | H04R 1/1083 |
| 2018/0103329 | A1 | 4/2018 | Shilton | |

FOREIGN PATENT DOCUMENTS

| | | | |
|---|---|---|---|
| EP | 2 840 807 | A1 | 2/2015 |
| JP | H10294989 | A | 11/1999 |
| JP | 2006514504 | A | 4/2006 |
| JP | 2008042508 | A | 2/2008 |
| JP | 2013531419 | A | 8/2013 |
| JP | 2013236396 | A | 11/2013 |
| JP | 2013546253 | A | 12/2013 |
| JP | 2015019353 | A | 1/2015 |
| WO | WO2007/106399 | A2 | 9/2007 |
| WO | WO 2008/098590 | A1 | 8/2008 |
| WO | WO2014053024 | A1 | 4/2014 |

OTHER PUBLICATIONS

International Preliminary Report on Patentability in cooresponding International application No. PCT/EP2016/057271, dated Oct. 12, 2017.

Boothroyd, A., "Hearing Aid Accessories for Adults: The Remote FM Microphone", Ear and Hearing, vol. 25, Issue 1: (Feb. 2004), pp. 22-33. (Abstract).

Hawkins, D., "Comparions of Speech Recognition in Noise by Mildly-to-Moderately Hearing-Impared Children Using Hearing Aids and FM Systems", Journal of Speech and Hearing Disorders, vol. 49, (Nov. 1984), pp. 409-418. (Abstract).

Pittman et al., "Recognition Performance for Four Combinations of FM System and Hearing Aid Microphone Signals in Adverse Listening Conditions", Ear and Hearing, vol. 20, Issue 4, (Aug. 1999), pp. 279-289. (Abstract).

Bertrand et al., "Robust Distributed Noise Reduction in Hearing Aids with External Acoustic Sensor Nodes", EURASIP Journal on Advances in Signal Processing, vol. 2009, (Jan. 2009) Article No. 12, pp. 1-14.

* cited by examiner

HEARING APPARATUS

This nonprovisional application is a continuation of International Application No. PCT/EP2016/057271, which was filed on Apr. 1, 2016, and which claims priority to European Patent Application No. 15162497.0, which was filed in Europe on Apr. 2, 2015, and which are both herein incorporated by reference.

BACKGROUND OF THE INVENTION

Field of the Invention

The invention relates to a hearing apparatus and to a method for operating a hearing apparatus. The hearing apparatus particularly comprises at least one of a first microphone and/or a second microphone, the first and the second microphone being arranged in at least one of a first hearing device and/or a second hearing device. The hearing apparatus further comprises a third microphone arranged in an external device, particularly in a cell phone, in a smart phone or in an acoustic sensor network. More specifically, the hearing apparatus comprises a first hearing device and a second hearing device which are interconnected to form a binaural hearing device.

Description of the Background Art

A hearing apparatus using one or more external microphones to enable a directional effect even when using omnidirectional microphones is disclosed, for example, in EP 2 161 949 A2, which corresponds to US 2010/0046775.

SUMMARY OF THE INVENTION

It is therefore an object of the invention to specify a hearing apparatus as well as a method of operating a hearing apparatus, which enable an improvement of the signal to noise ratio of the audio signal to be output to the user.

According to an exemplary embodiment of the invention, the object is achieved with a hearing apparatus comprising at least one of a first microphone and/or a second microphone which generate a first microphone signal and a second microphone signal, respectively, the first microphone and the second microphone being arranged in at least one of a first hearing device and/or a second hearing device, a third microphone which generates a third microphone signal, the third microphone being arranged in an external device (i.e. an external microphone), and a signal processing unit, wherein in the signal processing unit the third microphone signal and at least one of the first microphone signal and/or the second microphone signal are processed together and/or combined to an output signal with an enhanced signal to noise ratio (SNR) compared to the first microphone signal and/or the second microphone signal. Particularly, the hearing devices are embodied as hearing aids, and in the following description it is further often referred to hearing aids for simplification.

For a given noise scenario, strategic placement of external microphones can offer spatial information and better signal to noise ratio than the hearing aids signals generated by the own internal microphones. Nearby microphones can take advantage of the body of the hearing aid user in attenuating noise signals. For example, when the external microphone is placed in front and close to the body of the hearing aid user, the body shields noise coming from the back direction such that the external microphone picks up a more attenuated noise signal than compared to the hearing aids. This is referred to as the body-shielding effect. The external microphone signals that benefit from the body-shielding effect are then combined with the signals of the hearing aids for hearing aid signal enhancement.

External microphones, i.e. microphones not arranged in a hearing device, are currently mainly used as hearing aid accessories; however, the signals are not combined with the hearing aid signals for further enhancement. Current applications simply stream the external microphone signals to the hearing aids. Common applications include classroom settings where the target speaker, such as the teacher, wears a FM microphone and the hearing aid user listens to the streamed FM microphone signal. See, for example Boothroyd, A., "Hearing Aid Accessories for Adults: The Remote FM Microphone", Ear and Hearing, 25(1): 22-33, 2004; Hawkins, D., "Comparisons of Speech Recognition in Noise by Mildly-to-Moderately Hearing-Impaired Children Using Hearing Aids and FM Systems", Journal of Speech and Hearing Disorders, 49: 409-418, 1984; Pittman, A., Lewis, D., Hoover, B., Stelmachowicz P., "Recognition Performance for Four Combinations of FM System and Hearing Aid Microphone Signals in Adverse Listening Conditions", Ear and Hearing, 20(4): 279, 1999.

There is also a growing research interest in using wireless acoustic sensor networks (WASN's) for signal estimation or parameter estimation in hearing aid algorithms; however, the application of WASN's focuses on the placement of microphones near the targeted speaker or near noise sources to yield estimates of the targeted speaker or noise. See, for example Bertrand, A., Moonen, M. "Robust Distributed Noise Reduction in Hearing Aids with External Acoustic Sensor Nodes", EURASIP, 20(4): 279, 1999.

According to an embodiment of the invention the hearing apparatus comprises a left hearing device and a right hearing device which are interconnected to form a binaural hearing device. Particularly, a binaural communication link between the right and the left hearing device is established to exchange or transmit audio signals between the hearing devices. Advantageously, the binaural communication link is a wireless link. More preferably, all microphones used in the hearing apparatus are being connected by a wireless communication link.

The external device can be a mobile device (e.g. a portable computer), a smart phone, an acoustic sensor and/or an acoustic sensor element being part of an acoustic sensor network. A mobile phone or a smart phone can be strategically placed in front of the hearing device user to receive direct signals from a front target speaker or is during conversation with a front target speaker already in an excellent position when it is worn in a pocket. Wireless acoustic sensor networks are used in many different technical applications including hands free telephony in cars or video conferences, acoustic monitoring and ambient intelligence.

According to an embodiment the output signal can be coupled into an output coupler of at least one of the first hearing device and/or the second hearing device for generating an acoustic output signal. According to this embodiment the hearing device user receives the enhanced audio signal which is output by the signal processing unit using the external microphone signal via the output coupler or receiver of its hearing device.

The signal processing unit is not necessarily located within one of the hearing devices. The signal processing unit may also be a part of an external device. Particularly, the signal processing is executed within the external device, e.g.

a mobile computer or a smart phone, and is part of a particular software application which can be downloaded by the hearing device user.

As already mentioned, the hearing device is, for example, a hearing aid. According to yet another advantageous embodiment the hearing device is embodied as an in-the-ear (ITE) hearing device, in particular as a completely-in-canal (CIC) hearing device. For example, each of the used hearing devices comprises one single omnidirectional microphone. Accordingly, the first hearing device comprises the first microphone and the second hearing device comprises the second microphone. However, the invention does also cover embodiments where a single hearing device, particularly a single hearing aid, comprises a first and a second microphone.

In an embodiment of the invention the signal processing unit comprises an adaptive noise canceller unit, into which the third microphone signal and at least one of the first microphone signal and/or the second microphone signal are fed and further combined to obtain an enhanced output signal. The third microphone signal is particularly used like a beamformed signal to enhance the signal to noise ratio by spatial filtering. Due to its strategic placement a third microphone signal as such shows a natural directivity.

Advantageously, within the adaptive noise canceller unit at least one of the first microphone signal and/or the second microphone signal is preprocessed to yield a noise reference signal and the third microphone signal is combined with the noise reference signal to obtain the output signal. The first and/or the second microphone signal are specifically used for noise estimation due to the aforementioned body-shielding effect.

For example, in the adaptive noise canceller unit, the first microphone signal and the second microphone signal are combined to yield the noise reference signal. Particularly, a difference signal of the first microphone signal and the second microphone signal is formed. In case of a front speaker and a binaural hearing apparatus comprising a left microphone and a right microphone, the difference signal can be regarded as an estimation of the noise signal.

According to an embodiment of the invention, the adaptive noise canceller unit further comprises a target equalization unit, in which the first microphone signal and the second microphone signal are equalized with regard to target location components and wherein the equalized first microphone signal and the equalized second microphone signal are combined to yield the noise reference signal. Assuming a known target direction, according to an embodiment, simply a delay can be added to one of the signals. When a target direction of 0° is assumed (i.e. a front speaker) the left and the right microphone signals of a binaural hearing device are approximately equal due to symmetry.

In an embodiment, the adaptive noise canceller unit further comprises a comparing device in which the first microphone signal and the second microphone signal are compared for target speech detection, the comparing device generating a control signal for controlling the adaptive noise canceller unit, in particular such that the adaptive noise canceller unit is adapting only during the absence of target speech activity. This embodiment has the particular advantage of preventing target signal cancellation due to target speech leakage.

According to an embodiment, the signal processing unit further comprises a calibration unit and/or an equalization unit, wherein the third microphone signal and at least one of the first microphone signal and/or the second microphone signal are fed into the calibration unit for a group delay compensation and/or into the equalization unit for a level and phase compensation, and wherein the compensated microphone signals are fed into the adaptive noise canceller unit. With the implementation of a calibration unit and/or an equalization unit, differences between the internal microphone signals and between the internal and external microphone signals in delay time, phase and/or level are compensated.

The invention exploits the benefits of the body shielding effect in an external microphone for hearing device signal enhancement. The external microphone is particularly placed close to the body for attenuating the back directional noise signal. The benefit of the body-shielding effect is particularly useful in single microphone hearing aid devices, such as completely-in-canal (CIC) hearing aids, where attenuation of back directional noise at 180° is not feasible. When using only microphones of the hearing aid system, differentiation between the front (0°) and back (180°) locations is difficult due to the symmetry that exists along the median plane of the body. The external microphone benefitting from the body-shielding effect with the hearing aids does not suffer from this front back ambiguity as back directional noise is attenuated. The signals of the hearing aid microphones can thereby be enhanced to reduce back directional noise by combining the signals of the hearing aids with the external microphone.

The invention particularly offers additional signal enhancement to the hearing device signals instead of simply streaming the external microphone signal. The signal enhancement is provided through combining the signals of the hearing aid with the external microphone. The placement of the external microphone exploits the body-shielding effect, where the microphone is near the hearing aid user. Unlike wireless acoustic sensor networks, the placement of the microphone is not placed to be near the targeted speaker or noise sources.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
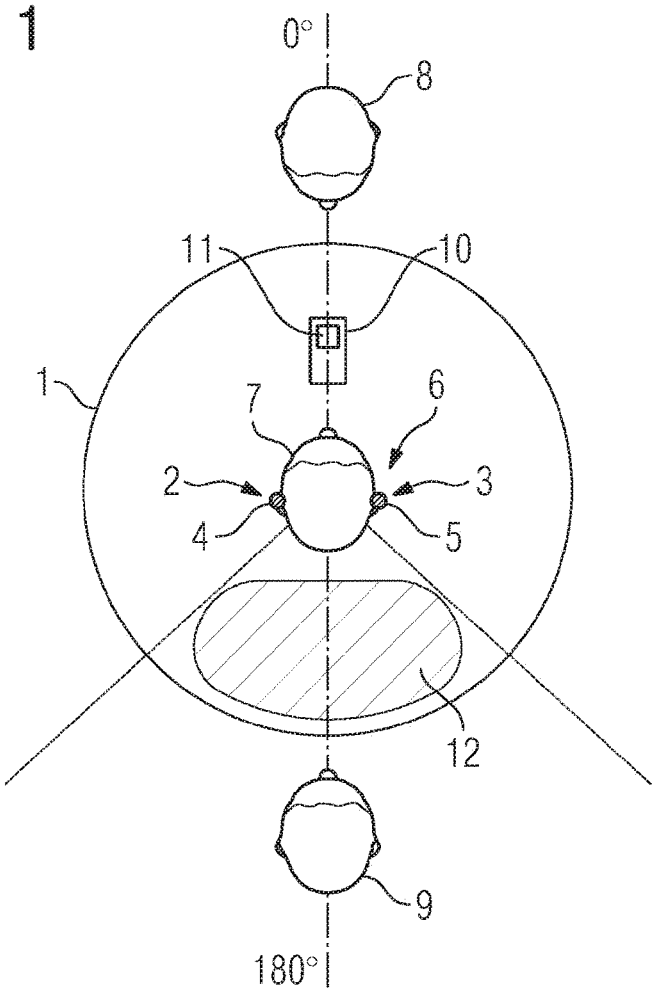
FIG. 1 shows a possible setup of an external microphone benefiting from the body-shielding effect.

FIG. 1 shows an improved hearing apparatus 1 comprising a first, left hearing device 2 and a second, right hearing device 3. The first, left hearing device 2 comprises a first, left microphone 4 and the second, right hearing device 3 comprises a second, right microphone 5. The first hearing device 2 and the second hearing device 3 are interconnected and form a binaural hearing device 6 for the hearing device user 7. At 0° a front target speaker 8 is located. At 180° an interfering speaker 9 is located. A smartphone 10 with a third, external microphone 11 is placed between the hearing device user 7 and the front target speaker 8. Behind the user 7 a zone 12 of back directional attenuation exists due to the body-shielding effect. When using the internal microphones 4, 5 of the hearing aid device 6, differentiation between the front (0°) and back (180°) locations is difficult due to the symmetry that exists along the median plane of the body. The external microphone 11 benefitting from the body-shielding effect does not suffer from this front-back ambiguity as back directional noise is attenuated. The signals of the hearing device microphones 4, 5 can thereby be enhanced to reduce back directional noise by combining the signals of the hearing device microphones 4, 5 with the signal of the external microphone 11.

Figure 2:
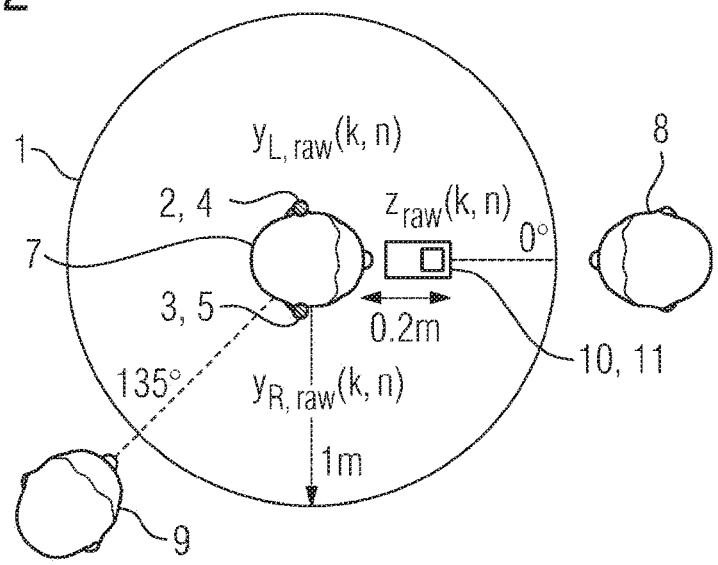
FIG. 2 shows a setup with hearing aids and a smartphone microphone, target and interfering speakers.

FIG. 2 depicts a scenario that is slightly different to the scenario shown in FIG. 1. An interfering speaker 9 is located at a direction of 135°. The third, external microphone 11, in the following referred to also as EMIC, of a smart phone 10 is placed between the hearing device user 7 and a front target speaker 8. The hearing devices 2, 3 are, for example, completely-in-canal (CIC) hearing aids (HA) which have one microphone 4, 5 in each device. The overall hearing apparatus 1 can include, for example, three microphones 4, 5, 11.

Let $y_{L,raw\ (t)}$, $y_{R,raw\ (t)}$ and $z_{raw\ (t)}$ denote the microphone signals received at the left and right hearing device 2, 3 and at the third external microphone 11 respectively at the discrete time sample t. The subband representation of these signals are indexed with k and n where k refers to the $k^{th}$ subband frequency at subband time index n. Before combining the microphone signals between the two devices 2, 3, hardware calibration is needed to match the microphone characteristics of the external microphone 11 to the microphones 4, 5 of the hearing devices 2, 3. In the exemplary approach, the external microphone 11 (EMIC) is calibrated to match one of the internal microphones 4, 5 which serves as a reference microphone. The calibrated EMIC signal is denoted by $z_{calib}$. In this embodiment, the calibration is first completed before applying further processing on the EMIC signal.

To calibrate for differences in the devices, the group delay and microphone characteristics inherent to the devices have to be considered. The audio delay due to analog to digital conversion and audio buffers is likely to be different between the external device 10 and the hearing devices 2, 3, thus requiring care for compensating for this difference in time delay. The group delay of the process between the input signal being received by an internal hearing device microphone 4, 5 and the output signal at a hearing aid receiver (speaker) is orders smaller than in complicated devices like smartphones. For example, the group delay of the external device 10 is first measured and then compensated if needed. To measure the group delay of the external device 10, one can simply estimate the group delay of the transfer function which the input microphone signal undergoes as it is transmitted as an output of the system. In the case of a smart phone 10, the input signal is the front microphone signal and the output is obtained through the headphone port. To compensate for the group delay, according to an embodiment $y_{L,raw}$ and $y_{R,raw}$ are delayed by the measured group delay of the EMIC device. The delayed signals are denoted by $y_L$ and $y_R$ respectively.

After compensating for different device latencies, it is recommended to use an equalization filter (EQ) which compensates for level and phase differences for microphone characteristics. The EQ filter is applied to match the EMIC signal to either $y_L$ or $y_R$, which serves as a reference denoted as $y_{ref}$. The EQ filter coefficients, $h_{cal}$, are calculated off-line and then applied during online processing. To calculate these weights off-line, recordings of a white noise signal is first made where the reference microphone and EMIC are held in roughly the same location in free field. A least-squares approach is then taken to estimate the relative transfer function for the input $z_{raw}$ to the output $y_{ref\ (k,\ n)}$ by minimizing the cost function:

$$\underset{h_{\mathrm{cal}(k)}}{\operatorname{argmin}} E[|e_{cal}(k)|^2] = E[|y_{ref}(k, n) - h_{cal}(k)^H z_{raw}(k, n)|^2.$$

where $z_{raw}$ (k, n) is a vector of current and past $L_{cal}-1$ values of $z_{raw}$ (k, n) and $L_{cal}$ is the length of $h_{cal}$ (k).

After calibration, in an exemplary study a strategic location of the external microphone 11 (EMIC) is considered. For signal enhancement, locations have been explored where the EMIC has a better SNR compared to the signals of the internal microphones 4, 5. It was focused on the scenario shown in FIG. 2 where the external microphone 11 is centered and in front of the body of the hearing device user 7 at a distance of 20 cm which is a typical distance for a smartphone usage. The target speaker 7 is located at 0° while the location of the noise interferer 9 is varied along a 1 m radius circle around the hearing device user 7. The location of the speech interferer 9 is varied in 45° increments and each location has an unique speech interferer 9 with different sound levels. The SNR of the EMIC and the CIC hearing aids 2, 3 are then compared when a single speech interferer 9 is active along with the target speaker 8. As a result, it was shown that the raw EMIC signal has a higher SNR than the raw hearing aid signal when the noise interferer 8 is coming from angles in the range of 135-225°. Additionally, it was shown that the SNR of the EMIC has similar performance of a signal processed using an adaptive first order differential beamformer (FODBF) realized on a two microphone behind-the-ear (BTE) hearing device. It should be noted that the FODBF cannot be realized on single microphone hearing aid devices such as the CICs since the FODBF would require at least two microphones in each device. Therefore, the addition of an external microphone 11 can lead to possibilities in attenuating noise coming from the back direction for single microphone hearing aid devices 2, 3.

The following exemplary embodiment presents a combination scheme using a Generalized Sidelobe Canceller (GSC) structure for creating an enhanced binaural signal using the three microphones according to a scenario shown in FIG. 1 or FIG. 2, assuming a binaural link between the two hearing devices 2, 3. An ideal data transmission link between the external microphone 11 (EMIC) and the hearing devices 2, 3 with synchronous sampling are also assumed.

Figure 3:
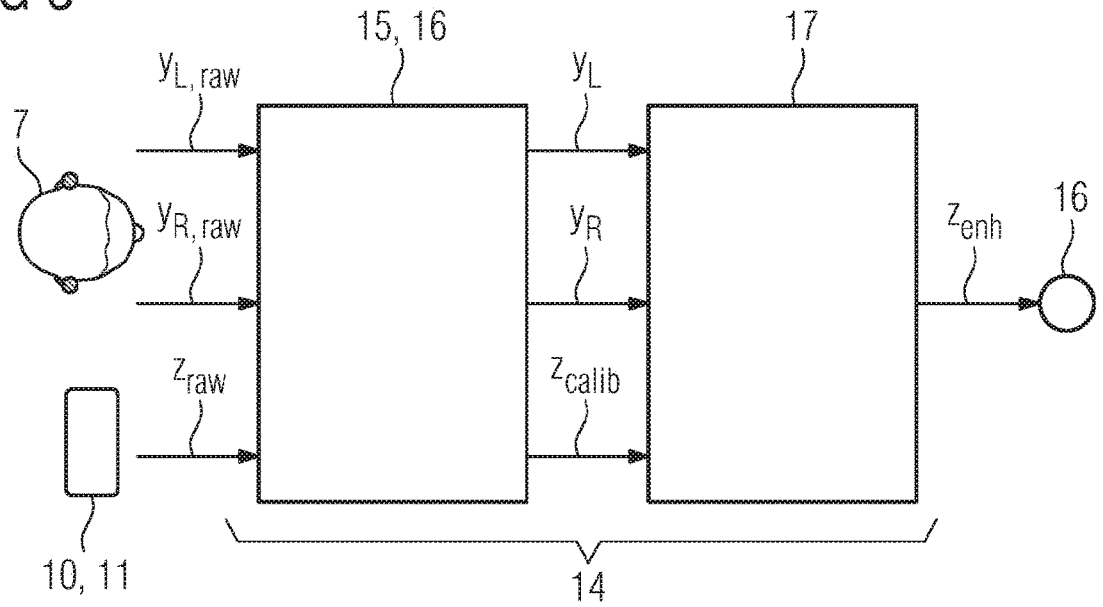
FIG. 3 depicts an overview of a signal combination scheme.

For combining the three microphone signals, a variant of a GSC structure is considered. A GSC beam-former is composed of a fixed beamformer, a blocking matrix (BM) and an adaptive noise canceller (ANC). The overall combination scheme is shown in FIG. 3 where hardware calibration is first performed on the signal of the external microphone, following with a GSC combination scheme for noise reduction, resulting in an enhanced mono signal referred to as $z_{enh}$. Accordingly, the signal processing unit 14 comprises a calibration unit 15 and an equalization unit 16. The output signals of the calibration and equalization unit 14, 15 are then fed to a GSC-type processing unit 17, which is further referred to as an adaptive noise canceller unit comprising the ANC.

Figure 4:
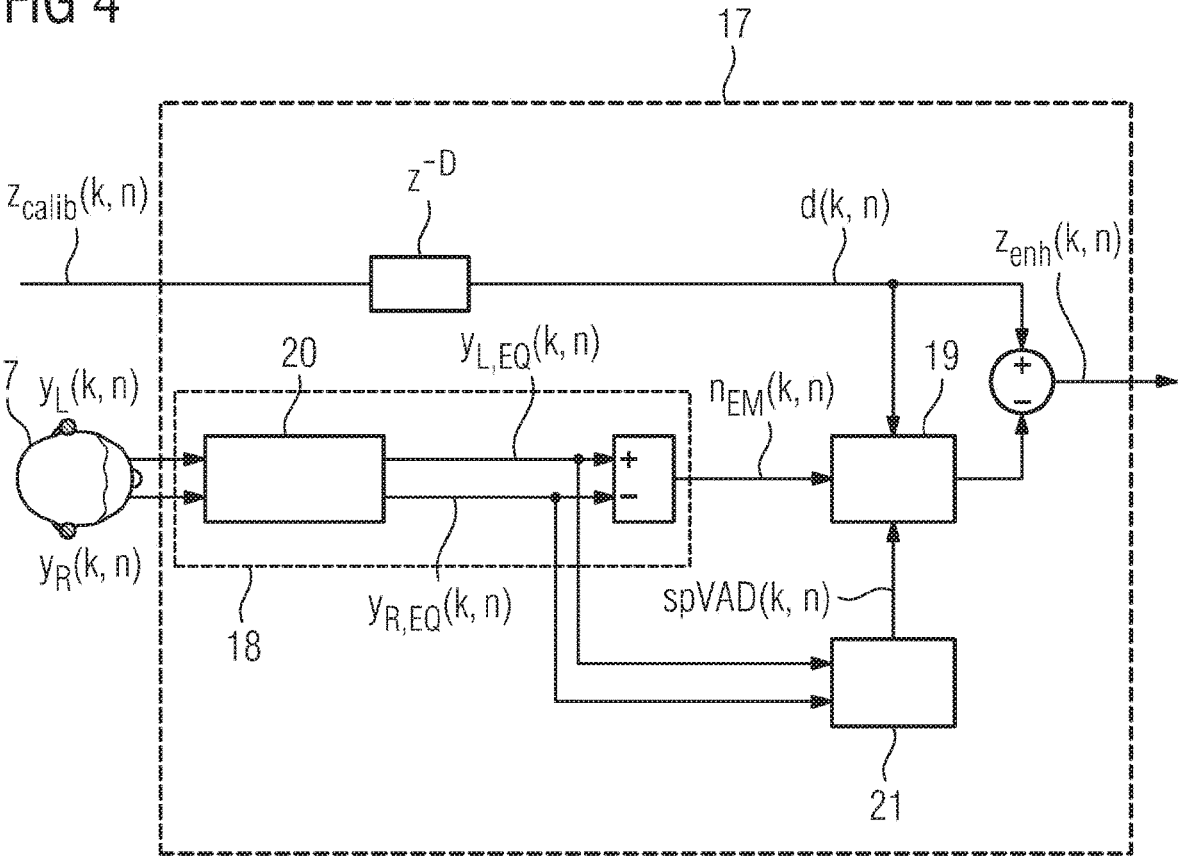
FIG. 4 shows a more detailed view of an adaptive noise cancellation unit.

Analogous to a fixed beamformer of the GSC, the EMIC signal is used in place of the beamformed signal due to its body-shielding benefit. The BM combines the signals of the hearing device pair signals to yield a noise reference. The ANC is realized using a normalized least mean squares (NLMS) filter. The GSC structure or the structure of the adaptive noise canceller unit 17, respectively, is shown in FIG. 4 and is implemented in the subband domain. The blocking matrix BM is denoted with reference numeral 18. The ANC is denoted with reference numeral 19.

The scheme used for the BM becomes apparent in FIG. 4 where $y_{L,EQ}$ and $y_{R,EQ}$ refer to the left and right hearing device signals after target equalization (in target equalization unit 20) and $n_{BM}$ refers to the noise reference signal. Assuming a known target direction, the target equalization unit 20 equalizes target speech components in the HA pair. In practice, a causality delay is added to the reference signal to ensure a causal system. For example if $y_L$ is chosen as the reference signal for target EQ, then $$y_{L,EQ}(k,n)=y_L(k,n-D_{tarEQ})$$

where $D_{tarEQ}$ is the causality delay added. Then $y_R$ is filtered such that the target signals are matched to $y_{L,EQ}$.

$$y_{R,EQ}(k,n)=h_{tarEQ}^{H}y_R(k,n)$$

where $y_R$ is a vector of current and past $L_{tarEQ}-1$ values of $y_R$ and $L_{tarEQ}$ is the length of $h_{tarEQ}$. The noise reference $n_{BM}$ (k, n) is then given by $$n_{BM}(k,n)=y_{L,EQ}(k,n)-y_{R,EQ}(k,n).$$

In practice, an assumption of a zero degree target location is commonly used in HA applications. This assumes that the hearing device user wants to hear sound that is coming from the centered front which is natural as one tends to face the desired speaker during conversation. When a target direction of 0° is assumed, the left and right hearing device target speaker signals are approximately equal due to symmetry. In this case, target equalization is not crucial and the following assumptions are made $$y_{L,EQ}(k,n)\approx y_L(k,n) \text{ and } y_{R,EQ}(k,n)\approx y_R(k,n).$$

The ANC is implemented with a subband NLMS algorithm. The purpose of the ANC is to estimate and remove the noise in the EMIC signal, $z_{calib}$. The result is an enhanced EMIC signal. One of the inputs of the ANC is $n_{BM}$, a vector of length $L_{ANC}$ containing the current and $L_{ANC}-1$ pass values of $n_{BM}$. A causality delay, D, is introduced to $z_{calib}$ to ensure a causal system.

$$d(k,n)=z_{calib}(k,n-D)$$

where d(k, n) is the primary input to the NLMS.

$$z_{enh}(k,n)=e(k,n)=d(k,n)-h_{ANC}(k,n)^{H}n_{BM}(k,n)$$

and the filter coefficient vector, $h_{ANC}$ (k, n), is updated by $$h_{ANC}(k,n+1)=h_{ANC}(k,n)+\frac{\mu(k)n_{BM}(k,n)e^{*}(k,n)}{n_{BM}(k,n)^{T}n_{BM}(k,n)+\delta(k)}$$

where μ(k) is the NLMS step size. The regularization factor δ(k) is calculated by δ(k)=αPz (k) where Pz (k) is the average power of the EMIC microphone noise after calibration and a is a constant scalar. It was found that α=1.5 was sufficient for avoiding division by zero during the above calculation.

To prevent target signal cancellation due to target speech leakage in $n_{BM}$, the NLMS filter is controlled such that it is adapted only during the absence of target speech activity. The target speech activity is determined by comparing in a comparing device 21 (see FIG. 4) the following power ratio to a threshold $T_k$. The power ratio considers the average power of the difference of the HA signals over average power of the sum.

$$spVAD(k,n)=\begin{cases}1, & \frac{|y_{L,EQ}(k,n)-y_{R,EQ}(k,n)|^2}{|y_{L,EQ}(k,n)+y_{R,EQ}(k,n)|^2}\le T_k\\ 0, & \text{otherwise}\end{cases}.$$

When target speech is active, the numerator of the ratio in the above formula is less than the denominator. This is due to equalization of the target signal components between the HA pair, thereby subtraction leads to cancellation of the target signal. The noise components, generated by interferers as point sources, are uncorrelated and would not cancel. The power of the difference versus the addition of the noise components would be roughly the same. When the ratio in the above equation is less than a predetermined threshold, $T_k$, target activity is present.

Using separate speech and noise recordings, the Hagerman method for evaluating noise reduction algorithms is used to evaluate the effect of GSC processing on the speech and noise separately. The target speech and noise signals are denoted with the subscripts of s and n respectively to differentiate between target speech and noise. Let s(k, n) denote the vector of target speech signals and n(k, n) denote the vector of noise signals where s(k, n)=[$y_{L,s}$ (k, n), $y_{R,s}$ (k, n), $z_s$ (k, n)] and n(k,n)=[$y_{L,n}$ (k, n), $y_{R,n}$ (k, n), $z_n$ (k, n)]. We then define two vectors of input signals of which GSC processing is performed on, $a_{in}$ (k, n)=s(k, n)+n(k, n) and $b_{in}$(k, n)=s(k, n)−n(k, n). The resulting processed outputs are denoted by $a_{out}$ (k, n) and $b_{out}$ (k, n) respectively. The output of the GSC processing is the enhanced EMIC signal as shown in FIG. 3. The processed target speech signal is estimated using $z_{enh,s}$ (k, n)=0.5($a_{out}$ (k, n)+$b_{out}$ (k, n)) and the processed noise signals is estimated using $Z_{enh,n}$ (k, n)=0.5($a_{out}$ (k, n)−$b_{out}$ (k, n)). Following the setup in FIG. 2, the GSC method is tested in various back directional noise scenarios. Using the separately processed signals, $z_{enh,s}$ (k, n) and $Z_{enh,n}$ (k, n), the true SNR values of the GSC enhanced signals and raw microphone signals are calculated in decibels and summarized in the following Table 1. The segmental SNR is calculated in the time domain using a block size of 30 ms and 50% overlap.

TABLE 1

Measures of GSC Performance in dB.

| Interferer Location | SNR of $y_L$ | SNR of $y_R$ | SNR of $z_{calib}$ | SNR of $z_{enh}$ | $P_{s_dist}$ | $P_{n_red}$ |
|---|---|---|---|---|---|---|
| 135° | 7.2 | 0.9 | 10.8 | 15.2 | 18.2 | 4.2 |
| 180° | 5.5 | 5.0 | 11.2 | 11.2 | 28.5 | 1.3e−2 |
| 225° | 5.3 | 7.9 | 13.9 | 16.9 | 19.0 | 3.1 |
| 135° + 225° | 3.1 | 0.1 | 9.1 | 9.9 | 21.5 | 0.8 |

Comparing the SNR of the calibrated external microphone signal to the HA pair, it is clear that the EMIC provides significant SNR improvement. Without GSC processing, strategic placement of the EMIC resulted on average at least 5 dB SNR improvement compared to the raw CIC microphone signal of the better ear. The result of GSC processing leads to further enhancement of at least 2 dB on average when there are noise interferers located at 135° or 225°.

In addition to SNR, speech distortion and noise reduction is also evaluated in the time domain to quantify the extent of speech deformation and noise reduction resulted from GSC processing. The speech distortion, $P_{s_dict}$, is estimated by comparing $d_s$, the target speech signal in d prior to GSC processing, and the enhanced signal $z_{enh,s}$, over M frames of N samples. N is chosen to correspond to 30 ms of samples and the frames have an overlap of 50%. The equation used is:

$$P_{s_dist} = \frac{10}{M}\sum_{m=0}^{M}\log\left[\frac{\sum_{Nm}^{Nm+N-1} d_s^2(t)}{\sum_{Nm}^{Nm+N-1}(z_{enh,s}(t)-d_s(t))^2}\right].$$

The noise reduction is estimated using:

$$P_{n_red} = 10\log\left[\frac{E\{d_n^2(t)\}}{E\{z_{enh,n}^2(t)\}}\right],$$

where $d_n$ refers to the noise signal in d. These measurements are represented in decibels and are shown also in Table 1.

External microphones have been proven to be a useful hearing device accessory when placed in a strategic location where it benefits from a high SNR. Addressing the inability for single microphone binaural hearing devices to attenuate noise from the back direction, the invention leads to attenuation of back interferers due to the body-shielding effect. The presented GSC noise reduction scheme provides further enhancement of the EMIC signal for SNR improvement with minimal speech distortion.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A system comprising: a hearing apparatus including at least one first microphone and a second microphone that generate a first microphone signal and a second microphone signal respectively, the at least one first microphone and the second microphone being arranged in a first hearing device and a second hearing device; and an external device including a third microphone that generates a third microphone signal, and a signal processing unit;

wherein, in the signal processing unit, the third microphone signal and at least one of the first microphone signal or the second microphone signal are processed together thereby producing an output signal with an enhanced signal to noise ratio compared to the first microphone signal or the second microphone signal, wherein the signal processing unit comprises an adaptive noise canceller unit into which the third microphone signal and the at least one of the first microphone signal or the second microphone signal are fed and further combined to obtain the output signal, and wherein the adaptive noise canceller unit further comprises a comparing device in which the first microphone signal and the second microphone signal are compared for target speech detection, the comparing device generating a control signal for controlling the adaptive noise canceller unit such that the adaptive noise canceller unit is adapting only during an absence of target speech activity.

2. The hearing apparatus as claimed in claim 1, wherein the external device is a mobile device, a smart phone, an acoustic sensor or an acoustic sensor element being part of an acoustic sensor network.

3. The hearing apparatus as claimed in claim 1, wherein the output signal is coupled into an output coupler of the first hearing device or the second hearing device for generating an acoustic output signal.

4. The hearing apparatus as claimed in claim 1, wherein the first hearing device and the second hearing device are each embodied as an in-the-ear hearing device.

5. The hearing apparatus as claimed in claim 1, wherein the first hearing device comprises the at least one first microphone, and wherein the second hearing device comprises the second microphone.

6. The hearing apparatus as claimed in claim 1, wherein, in the adaptive noise canceller unit, the at least one of the first microphone signal or the second microphone signal is preprocessed to yield a noise reference signal and the third microphone signal is combined with the noise reference signal to obtain the output signal.

7. The hearing apparatus as claimed in claim 6, wherein, in the adaptive noise canceller unit, the first microphone signal and the second microphone signal are combined to yield the noise reference signal.

8. The hearing apparatus as claimed in claim 7, wherein the adaptive noise canceller unit further comprises a target equalization unit, in which the first microphone signal and the second microphone signal are equalized with regard to target location components, and wherein the equalized first microphone signal and the equalized second microphone signal are combined to yield the noise reference signal.

9. The hearing apparatus as claimed in claim 1, wherein the signal processing unit further comprises a calibration unit and/or a equalization unit, wherein the third microphone signal and the at least one of the first microphone signal or the second microphone signal are fed into the calibration unit for a group delay compensation and/or into the equalization unit for a level and phase compensation, and wherein compensated microphone signals are fed into the adaptive noise canceller unit.

10. The hearing apparatus as claimed in claim 1, wherein the third microphone is calibrated to match the at least one first microphone or the second microphone.

11. The hearing apparatus as claimed in claim 1, wherein the third microphone is calibrated based on microphone characteristics of the at least one first microphone, the second microphone, or the third microphone.

12. The hearing apparatus as claimed in claim 1, wherein a latency of the third microphone is measured according to the at least one first microphone or the second microphone for calibration.

13. The hearing apparatus as claimed in claim 1, wherein the first hearing device and the second hearing device are each embodied as a completely-in-canal hearing device.

14. A method comprising:

generating, by a first microphone, a first microphone signal;

generating, by a second microphone, a second microphone signal;

generating, by a third microphone, a third microphone signal;

processing, by a signal processing unit, a third microphone signal and at least one of the first microphone signal and the second microphone signal;

producing, by the signal processing unit, an output signal with an enhanced signal to noise ratio compared to the first microphone signal or the second microphone signal, wherein at least one of the first microphone and the second microphone is arranged in a hearing device, wherein the third microphone is arranged in an external device, wherein, in the signal processing unit, the third microphone signal and at least one of the first microphone signal or the second microphone signal are processed together thereby producing an output signal with an enhanced signal to noise ratio compared to the first microphone signal or the second microphone signal, wherein the signal processing unit comprises an adaptive noise canceller unit into which the third microphone signal and the at least one of the first microphone signal or the second microphone signal are fed and further combined to obtain the output signal, and wherein the adaptive noise canceller unit further comprises a comparing device in which the first microphone signal and the second microphone signal are compared for target speech detection, the comparing device generating a control signal for controlling the adaptive noise canceller unit such that the adaptive noise canceller unit is adapting only during an absence of target speech activity.

15. The method as claimed in claim 14, further comprising calibrating the third microphone before processing the third microphone signal.

16. The method as claimed in claim 14, further comprising estimating a speech distortion by comparing a target speech signal to the output signal.

17. The method as claimed in claim 14, wherein the enhanced signal to noise ratio is obtained by spatial filtering.

18. The method as claimed in claim 14, further comprising placing the third microphone close to a user's body to attenuate a directional noise signal.

19. The hearing apparatus according to claim 1, wherein the external device is a smart phone and the signal processing unit is embodied within the external device.

20. The method according to claim 14, wherein the external device is a smartphone.

21. A system comprising: a hearing apparatus including at least one first microphone and a second microphone that generate a first microphone signal and a second microphone signal respectively, the at least one first microphone and the second microphone being arranged in a first hearing device and a second hearing device; and external device including a third microphone that generates a third microphone signal, and the external device being a smartphone; and a signal processing unit, embodied within the external device, wherein, in the signal processing unit, the third microphone signal and at least one of the first microphone signal or the second microphone signal are processed together thereby producing an output signal with an enhanced signal to noise ratio compared to the first microphone signal or the second microphone signal, wherein the signal processing unit comprises an adaptive noise canceller unit into which the third microphone signal and the at least one of the first microphone signal or the second microphone signal are fed and further combined to obtain the output signal, and wherein the adaptive noise canceller unit further comprises a comparing device in which the first microphone signal and the second microphone signal are compared for target speech detection, the comparing device generating a control signal for controlling the adaptive noise canceller unit such that the adaptive noise canceller unit is adapting only during an absence of target speech activity.

* * * * *